United States Patent [19]

Thrasher et al.

[11] Patent Number: 4,938,203

[45] Date of Patent: Jul. 3, 1990

[54] PULSE COMBUSTION APPARATUS

[75] Inventors: William H. Thrasher, North Royalton; Robert A. Borgeson, Cleveland Hts., both of Ohio; Lloyd R. Maschhoff, Belleville, Ill.; Charles M. Pavlik; Steven J. Tucky, both of Cleveland, Ohio; Jeffrey L. West, Newport Beach, Calif.

[73] Assignee: Gas Research Institute, Chicago, Ill.

[21] Appl. No.: 320,463

[22] Filed: Mar. 8, 1989

[51] Int. Cl.[5] ..... F24H 3/00

[52] U.S. Cl. ..... 126/110 R; 431/1

[58] Field of Search ..... 431/1; 126/116 R, 116 A, 126/116 B, 110 R

[56] References Cited

U.S. PATENT DOCUMENTS

| | | | |
|---|---|---|---|
| 4,336,791 | 6/1982 | Kitchen | 126/116 A |
| 4,601,654 | 7/1986 | Kitchen | 126/116 A |
| 4,640,674 | 2/1987 | Kitchen | 431/1 |

FOREIGN PATENT DOCUMENTS

| | | | |
|---|---|---|---|
| 208600 | 1/1987 | European Pat. Off. | 431/1 |
| 937081 | 9/1961 | United Kingdom | 431/1 |

OTHER PUBLICATIONS

R. A. Borgeson et al., "Development of a Pulse Combustion Space Heater", Report No. GRI-87/0142, Apr. 1987, Gas Research Institute, 8600 Bryn Mawr Ave., Chicago, Ill. 60631.

*Primary Examiner*—Carroll B. Dority

*Attorney, Agent, or Firm*—Pearne, Gordon, McCoy & Granger

[57] ABSTRACT

A pulse combustion space heater and burner are disclosed. The heater has an exterior cabinet enclosing an interior housing having the burner mounted therein. The burner includes a plurality of generally flat elements which cooperate with the interior housing to provide a tortuous path for air circulated through the chamber during heat transfer. A labyrinthine air flow passageway lined with sound attenuating material is provided immediately upstream of the heater air discharge. The burner tailpipe comprises a weldment of two identical sheet metal pieces which cooperatively define a tailpipe conduit. A fuel gas inlet orifice is mounted in the wall of the mixer head to effect both regulation of the average flow rate and injection of the fuel to enhance its mixture with the air.

22 Claims, 4 Drawing Sheets

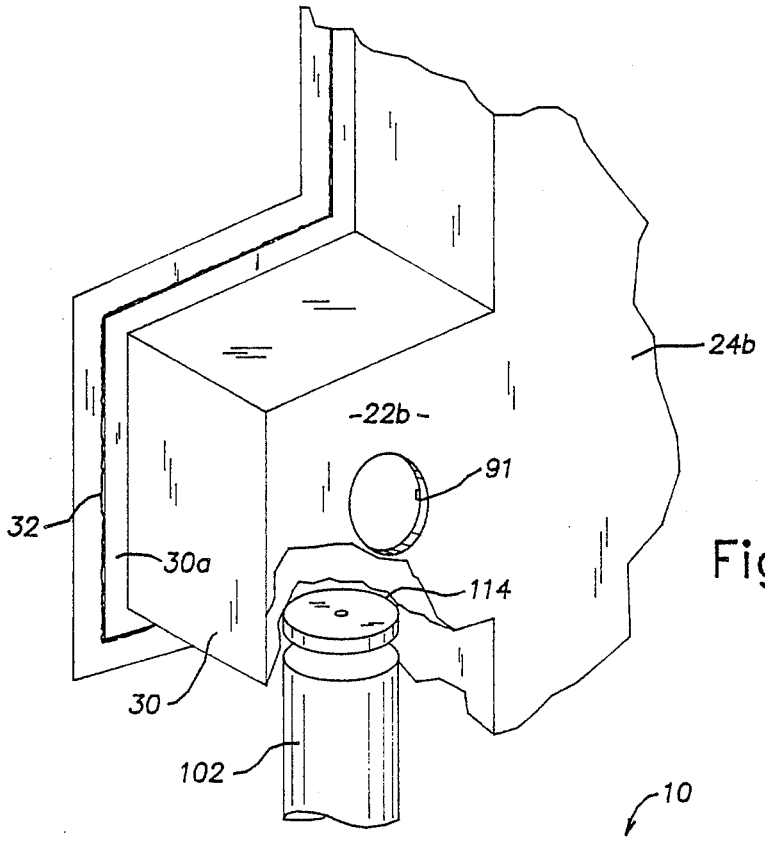
Fig. 4
Fig. 5
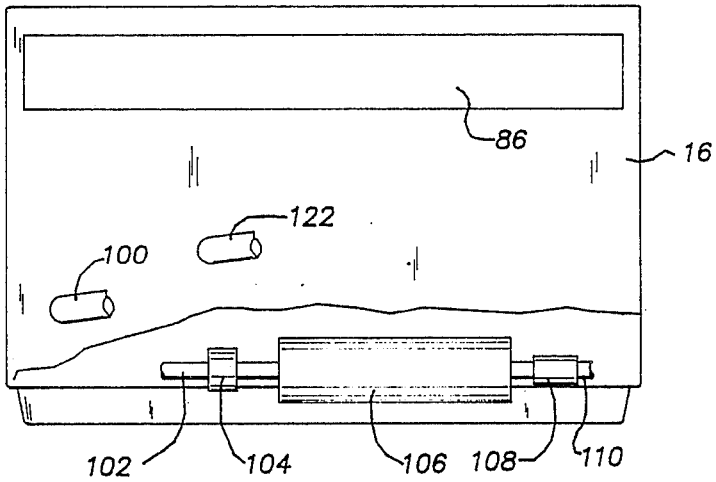

PULSE COMBUSTION APPARATUS

BACKGROUND OF THE INVENTION AND PRIOR ART

This invention relates to pulse combustion burners, and to gas-fired pulse combustion heating appliances including space heaters incorporating such burners.

The development of suitable pulse combustion furnaces has enabled the advantages and efficiencies of pulse combustion to be attained in residential central heating. In addition to the advantages of self-sustaining operation, the steady state thermal efficiency of such central heating systems may be in the range of 90 to 99% and provide significant operating cost savings. There is a need for a pulse combustion fired space heater to provide comparable advantages and thermal efficiencies.

The development of a suitable space heater involves restrictive size and noise suppression requirements since space heaters are not typically isolated in a basement or closet as in the case of a central heating furnace. For a heater capacity of about 20,000 BTU/hr. to be used in residential applications, the compact size requirements of commercially sized space heaters require that the overall size of the appliance be about 3' long, 2' tall and 1' wide. The sound level of the unit at a distance of 3' should be about 53 dBA or less.

The imposition of size requirements, especially the relatively compact dimensions contemplated herein, are particularly difficult to meet in pulse combustion systems since the resonant operation thereof requires certain geometric configurations and/or size relationships to be observed. More particularly, in pulse combustion burners of the Helmholtz type, an oscillating or pulsed flow of combustion gases through the burner is maintained at a frequency determined by burner component geometry and fuel supply characteristics including mixing the air and fuel components to provide a homogeneous air/fuel mixture. Typically, a combustion chamber of a given size cooperates with a tailpipe or exhaust pipe of specific dimensions to provide explosive combustion cycles, thermal expansion of the combustion gases, and oscillating gas pressures which provide a pulsed flow of combustion gases through the burner with alternating negative and positive pressure phases. In order to make the pulse combustion process self-sustaining, the oscillating gas pressures may be used to provide self-feeding of a combustible gaseous mixture. Accordingly, the close relationship between pulse combustion operation and heater geometry restricts variation in the spatial arrangement and compaction of the heater elements to meet commercial size and sound attenuation requirements. Also, the amounts of circulating air flow necessary for temperature conditioning the spaces must be maintained and adequate heat transfer surfaces must be provided for efficient heat transfer.

SUMMARY OF THE INVENTION

In accordance with the present invention, an improved pulse combustion burner and space heater are provided. The burner and heater achieve the desired compactness of size and quietness of operation.

In the space heater of the present invention, the air from the space to be temperature conditioned is circulated into contact with the exterior surfaces of the burner for transfer of combustion heat to the air. Prior to discharge from the heater, the air flows through a discharge silencer comprising a labyrinthine air flow passageway wherein sound attenuation material causes changes in the direction of air flow to trap and dissipate acoustic energy. Heat transfer and sound attenuation are each simultaneously effected in part in a common portion of the labyrinthine air flow passageway to further enhance the compactness of the heater. As used herein, sound attenuation material refers to known materials specially constructed to attenuate sound by absorption, blocking or otherwise reducing acoustic energy. Examples of such materials include foil/glass fiber laminates, decoupled foam, acoustically absorbing foam, wool and sand.

A multilayer arrangement of the pulse burner elements in the space heater presents a tortuous and/or extended flow path for air to be conditioned during heat transfer with the burner elements. The burner elements are enclosed within an interior housing arranged to cooperate with the burner elements to define the flow path for the air to be conditioned. An initial portion of the labyrinthine air flow path of the discharge silencer is defined by one of the burner elements and an adjacent wall of the interior housing which is perforated and backed by a sound attenuating material disposed against it. A final portion of the labyrinthine air flow path is located opposite the discharge opening. The length of the sound attenuating flow path is thereby increased with no substantial loss in heat transfer.

The air to be temperature conditioned is passed in countercurrent heat transfer with the burner elements in the space heater by sequentially contacting elements of increasing operating temperature. Countercurrent heat transfer enables the combustion gases to be cooled to their dew point or condensing temperature and the coolest or most downstream heater element to operate as a condenser.

The burner elements have a generally flat box-shape and they are oriented in spaced vertical planes as an assembly or array of rigid elements within the interior housing of the space heater. The exterior surfaces of the burner elements baffle air flow along a serpentine path defined by the elements and adjacent wall portions of the interior housing.

The tailpipe has a vertical plane of bilateral symmetry and it is constructed of identical sheet metal halves as a fluid-tight weldment defining an arcuate conduit or flow path for the combustion products. The non-conduit portions of the tailpipe are substantially flat fin surfaces for minimizing the thickness of the tailpipe and enhancing the heat transfer to circulating air contacting the exterior tailpipe surfaces. The non-conduit portions of the tailpipe also direct air flow and cooperate to provide the serpentine flow path through the array of upstanding burner elements.

In order to enhance the homogeneity of the air/fuel mixture and to reduce the mixing time or ignition delay time, the burner includes a mixer head having a flow restricting orifice located in the fuel inlet in the mixer head wall. The orifice enables the negative pressure phase of the pulse combustion cycle to be utilized fully to inject and accelerate the fuel into the mixer head. In this manner, substantially all of the energy available from the negative phase of the pulse cycle is converted to the kinetic energy of the injected fuel stream to maximize the turbulence of mixing and reduce the mixing time.

The thermal steady state efficiency of the space heater is in the range of 90%. Accordingly, the pulse combustion space heater provides a directly vented heater appliance having an efficiency approaching that of an unvented heater without the disadvantages of discharging the combustion products into the conditioned air space. The self-feeding characteristics of pulse combustion also facilitate the use of outdoor air for purposes of combustion. In comparison with the use of indoor air, the outdoor air tends to have a lower content of chlorides which are particularly associated with the corrosion of metallic combustion apparatus.

BRIEF DESCRIPTION OF THE DRAWINGS

FIG. 4 is a perspective view on an enlarged scale of the mixer head of the burner as viewed from the rear in FIG. 1, with parts broken away and omitted for clarity of illustration; and FIG. 5 is a rear elevational view on a reduced scale of the space heater with parts broken away.

DETAILED DESCRIPTION OF THE DRAWINGS

Figure 1:
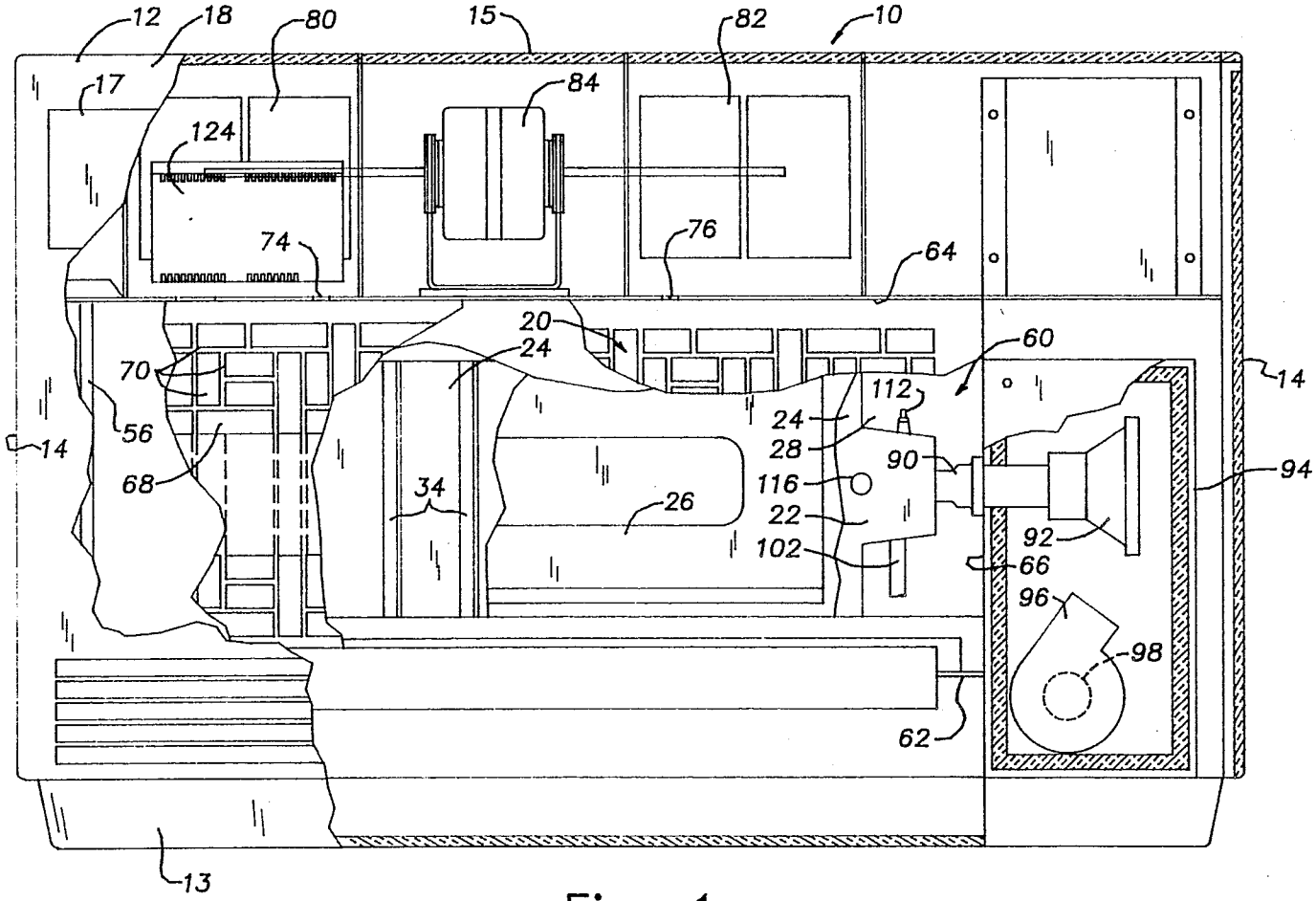
FIG. 1 is a somewhat schematic front elevational view of a space heater including a pulse combustion burner in accordance with the invention with parts broken away and omitted for clarity of illustration.
Figure 2:
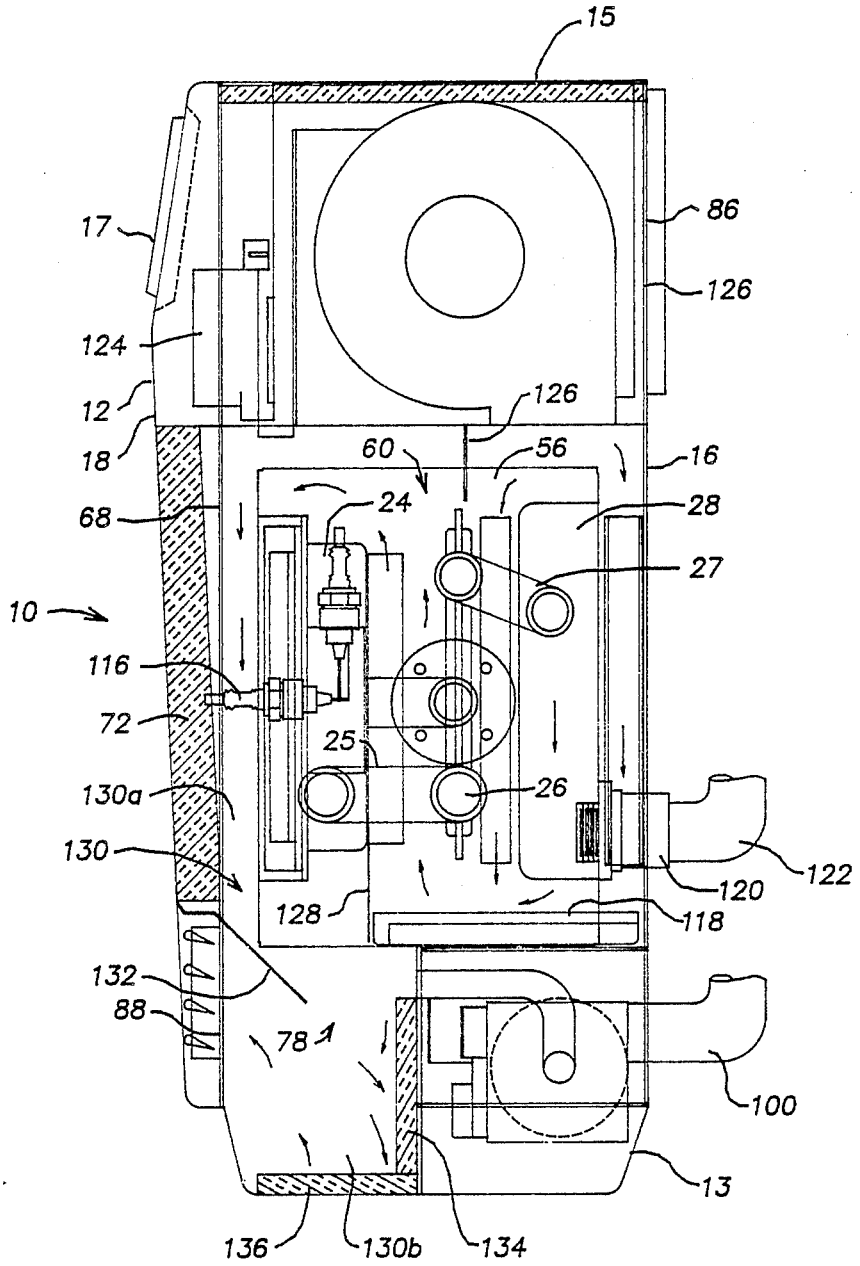
FIG. 2 is a side elevational view of the heater of FIG. 1.

Referring to FIGS. 1 and 2, a space heater 10 is shown. The heater 10 is of the free standing type, but it may be modified for wall mounting. The heater 10 includes a cabinet 12 having a recessed base 13, sidewalls 14, a top wall or closure 15, a rear wall 16, and a demountable front wall 18. An access door 17 is provided in the front wall 18 for adjustment of the heater controls.

The cabinet 12 is a sheet metal construction, and one or more of the sidewalls 14 and top wall 15 as well as the front wall 18 may be demountable for access to the interior components. The cabinet 12 is 35" wide, 24" high, and 12" deep. The heater 10 is sized to operate at an input rate of about 20,000 BTU/hr.

A pulse combustion burner or heater 20 is mounted within the cabinet 12. The major elements or components of the burner 20 include a mixer head 22, a combustion chamber 24, a tailpipe or exhaust pipe 26 and an exhaust decoupler 28. The burner 20 is formed of a suitable material such as 12 to 14 gauge steel and is conveniently fabricated as a weldment. Thinner gauge steel may be used to fabricate the tailpipe 26 and exhaust decoupler 28. The exhaust decoupler 28 is preferably made of stainless steel since condensate is collected therein. In fact, a plastic material may be utilized since the gas temperatures within the exhaust decoupler 28 are in the range of about 110° to 300° F.

Figure 3:
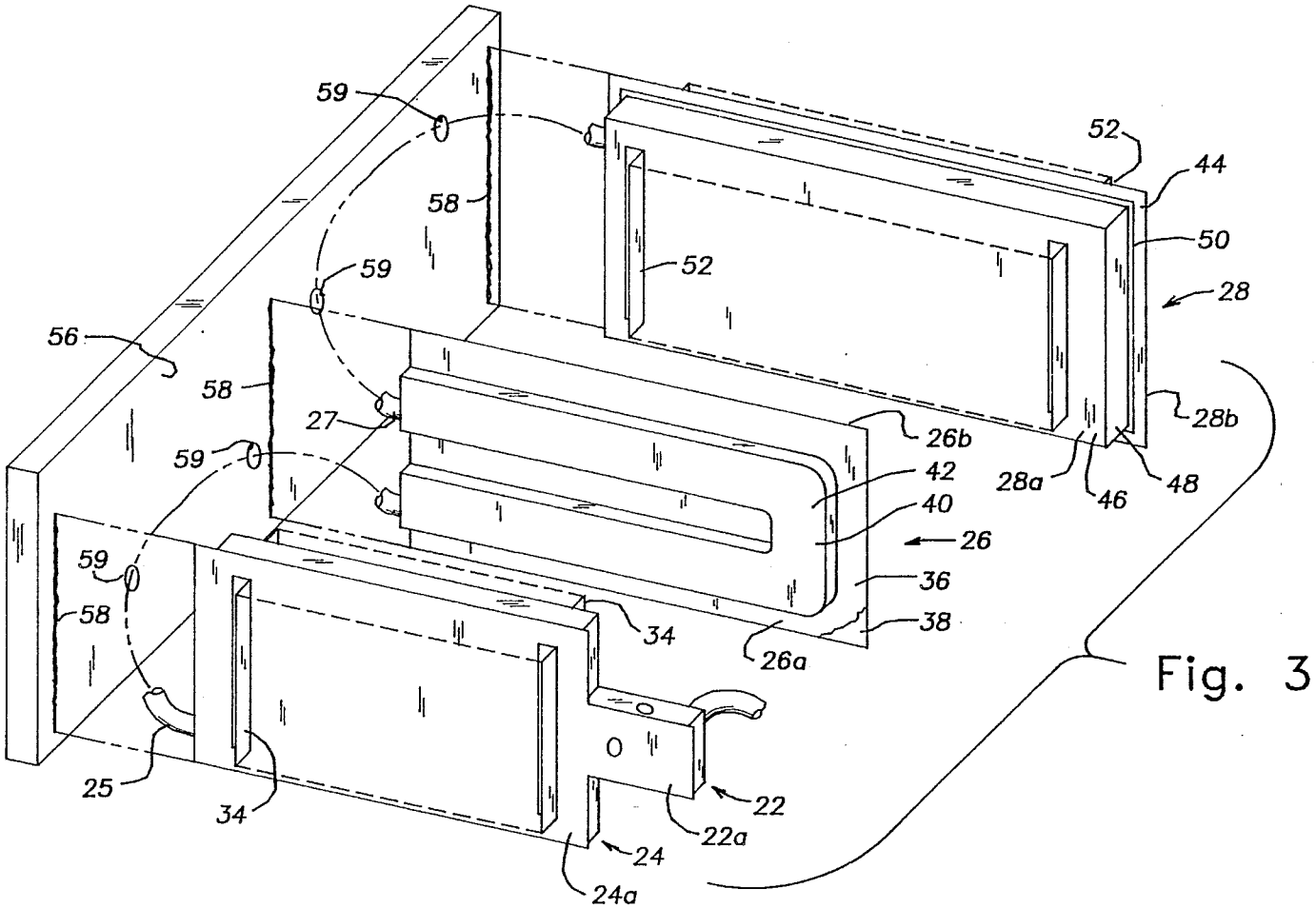
FIG. 3 is a perspective view on an enlarged scale of the burner elements of the pulse combustion burner shown in FIG. 1 with the spacing between elements increased for clarity of illustration.

Each of the major elements of the burner 20 has a flat, box-like configuration and a rectangular cross-section as best shown in FIG. 3. Such configuration facilitates fabrication of the heater elements, provides a high surface to cross-sectional area ratio and cooperates to define a flow path through the heater 10 for the air to be heated as described more fully below.

The mixer head 22 and combustion chamber 24 are integrally formed using two pieces of sheet metal. Referring to FIGS. 3 and 4, a first flat piece of sheet metal provides a common mixer head front wall 22*a* and combustion chamber front wall 24*a*. A second piece of sheet metal having a recess therein which corresponds with the mixer head and combustion chamber volumes or cavities per se provides mixer head rear wall 22*b* and combustion chamber rear wall 24*b* as well as a narrow peripheral wall 30 which corresponds with the side or depth of the recess. The recess in the second sheet metal piece may be formed by stamping, drawing or otherwise deforming flat sheet metal stock.

A flange 30*a* is provided adjacent the front edge of the peripheral wall 30 to facilitate welding to the common front wall 22*a*, 24*a* of the mixer head and combustion chamber. As best shown in FIG. 4, a continuous weld 32 is provided to assure a fluid-tight connection.

A plurality of L-shaped fins 34 are provided along both the front wall 24*a* and the rear wall 24*b* of the combustion chamber 24. In addition to enhancing heat transfer, the fins 34 also increase the rigidity of the combustion chamber 24 and reduce its tendency to vibrate.

Referring to FIGS. 2 and 3, the tailpipe 26 is constructed of two identical pieces of sheet metal 36 and 38 which respectively form front and rear walls 26*a* and 26*b* of the tailpipe 26. Each of the sheet metal pieces 36, 38 has an elongate U-shape recess 40 which cooperatively form a tailpipe conduit 42. The remaining portions of the sheet metal pieces 36 and 38 extending about the periphery of the tailpipe conduit 42 are substantially flat and sealed together in a fluid-tight joint as by welding.

The exhaust decoupler 28 is constructed in a manner similar to the combustion chamber 24. To that end, a front wall 28*a* is formed by a first sheet metal piece 44 which closes an open end of a rectangular recess in a second sheet metal piece 46 which forms the rear wall 28*b* of the decoupler. A peripheral wall 48 is formed by the side of the recess and it terminates at a flange 50. The flange 50 is provided for convenience in forming a continuous weld and a fluid-tight seal between the sheet metal pieces 44 and 46.

A plurality of L-shaped fins 52 are provided along the front and rear walls 28*a*, 28*b* of the exhaust decopler 28. The fins 52 enhance heat transfer and rigidify the sheet metal pieces 44, 46 in order to prevent vibration. The exhaust decoupler 28 also tends to muffle or restrict the noise level of the burner operation and operates as a condenser as described more fully below.

As best shown in FIG. 3, the combustion chamber 24 and integral mixer head 22, tailpipe 26 and exhaust decoupler 28 are mounted in an assembly or array 54 to an interior sidewall 56. To that end, each of the adjacent ends of the combustion chamber 24, tailpipe 26 and exhaust decoupler 28 is rigidly secured to the wall 56 as by welds 58. A reinforcing flange 56*a* extends about the periphery of the wall 56. The lines 25 and 27 extend through openings 59 in the sidewall 56.

The assembly 54 of burner elements 22, 24, 26 and 28 is mounted within an interior housing 60 generally enclosed within the cabinet 12. The housing 60 includes a lower wall 62 and an upper wall 64 connected by a right sidewall 66. The interior wall 56 provides the left sidewall of the interior housing 60. The rear wall 16 of the cabinet 12 also provides the rear wall of the housing 60. The housing 60 has a perforated front wall 68 including a plurality of apertures 70 extending therethrough and arranged in a pattern designed to maximize sound attenuation. A sound attenuating material 72 mounted to the front wall 18 of the cabinet 12 is disposed against the adjacent side of the front wall 68 of the housing 60. The sound attenuating material 72 comprises a foil and glass fiber batt laminate.

Circulating air inlets 74 and 76 are provided in the upper wall 64 of the housing 60. The circulating air is discharged from the interior housing 60 through a circulating air outlet opening generally indicated at 78 in FIG. 2. Accordingly, the housing 60 defines a substantially closed heat transfer chamber 61 having the burner element assembly 54 mounted therein for heat transfer to the circulating air contacting the exterior surfaces of the burner elements.

Referring to FIG. 1, a pair of blowers 80 and 82 are mounted in an upper portion of the cabinet 12 for supplying air to the inlet openings 74 and 76. The blowers 80, 82 are driven by an electric motor 84.

The blowers 80 and 82 are arranged to draw air into the heater 10 through an intake opening 86 in the rear wall 16 of the cabinet 12. Following the heating of the air as described below, the warm air is returned to the space through louvered discharge opening 88 in the front wall 18 of the cabinet 12.

Fuel and air are supplied to the mixer head 22 to provide a combustible mixture of gases which is ignited and delivered to the combustion chamber 24. To that end, an air line 90 is connected to a mixer head air inlet 91 at the center of the rear wall **22*b* of the mixer head 22. The line 90 extends to a flapper air valve 92 arranged for one-way flow into the mixer head 22. The air valve 92 is located within a closed air decoupler 94 mounted within the cabinet 12**.

Outside air is drawn into the decoupler 94 through a purge blower 96 which is also mounted in the decoupler. The purge blower is only powered before and after burner operation. Accordingly, an outside air inlet 98 extends from the decoupler 94 and through the wall 16 of the cabinet 12 for connection to an air supply pipe 100 arranged to draw atmospheric combustion air. In this manner, a pressurized supply of air is maintained in the decoupler 94 for self-feeding of the burner 20 via the air valve 92. Alternatively, the air supply line 100 may draw combustion air from the space to be heated.

A supply of fuel gas, such as natural gas, is delivered to the mixer head 22 through gas line 102. A gas valve 104 (FIG. 5) comprising a one-way flapper valve is arranged in the gas line 102 for intermittent flow of gas to the mixer head in response to the pulse combustion operation. A gas decoupler 106 is also located in the gas line 102 in order to isolate the supply of gas to the burner 20 from downstream pressure variations. A gas pressure regulator 108 is located upstream of the decoupler 106 in a gas supply line 110 which is connected to a supply of fuel gas. In addition to natural gas, the burner 20 may also be operated using a propane fuel supply with adjustment of the gas flow.

For purposes of ignition during start-up, an igniter 112 is mounted in the front wall **22*a* of the mixer head 22. The igniter 112 may comprise an automotive spark plug having its electrode positioned within the mixing head 22. A flame sensor 116 is mounted through the wall 22*a* of the mixer head 22**, and it is arranged to shut off the flow of fuel if proper combustion is not detected.

The air line 90 and gas line 102 provide intersecting substantially perpendicular flows to enhance the mixing of the air and fuel gas. Further, a gas inlet orifice 114 (FIG. 4) is mounted at the end of the gas line 102 in the lower peripheral wall 30 of the mixer head 22. The orifice 114 has a 0.136" I.D. opening for regulating the average flow rate of fuel through the gas line 102. Except for the gas valve 104, there are no other flow regulating valves between the pressure regulator 108 and the orifice 114. Accordingly, the entire pressure difference between the pressure upstream of the gas valve 104 and the negative operating pressure of the burner 20 is used to enhance the turbulence of mixing and reduce the mixing time. The gas inlet orifice 114 thereby operates as both a gas flow regulating orifice and an injector for the fuel.

In the space heater 10, mixing effectiveness is achieved at the 20,000 BTU/hr. input rate with typical residential appliance gas pressures (i.e. 3 to 3.5" W.C.) and orifice openings varying in the size range of 0.136"±0.05" I.D. The distance between the center of the air inlet 91 and the plane of the opening in the orifice 114 is about 1.625". If propane is used as a fuel, a smaller size orifice opening is used.

A condensate collection pan 118 is carried on the lower support wall 62 of the interior housing 60. Condensate is removed from the exhaust decoupler 28 through a suitable trap and passed into the pan 118. The collection pan 118 is sized to permit evaporation of the collected condensate. Alternatively, the condensate may be discharged with the combustion products to the atmosphere through decoupler outlet 120 and vent 122.

For purposes of automatic operation, the heater 10 is provided with conventional thermostatic controls as indicated at 124 to cause operation in accordance with sensed temperature conditions. In response to a start-up signal, the heating cycle begins by operation of purge blower 96 for about 30 seconds to clear the internal flow passages of the burner 20. The igniter 112 and gas control valve 108 are then actuated and cooperate with the blower 96 to begin the combustion process, air and fuel being delivered to the mixer head 22 for ignition by the igniter 112. Once combustion is initiated, the operation of the blower 96 and igniter 112 are discontinued.

In accordance with pulse combustion operation, explosive combustion causes a positive pressure in the combustion chamber 24 which closes the air and gas valves 92 and 104, forcing the combustion gases to exhaust as they advance through downstream elements of the burner. This causes the pressure in the combustion chamber 24 to decrease below atmospheric pressure and to open the valve 92 and 104 to draw in a fresh charge of air and fuel. This fresh charge is automatically reignited by the residual hot gases and the cycle is started once again. In this manner, self-sustaining operation is provided.

The hot combustion gases travelling through the combustion chamber 24, tailpipe 26 and exhaust decoupler 28 cause these elements to rapidly increase in temperature. A conventional timer control may be used to cause automatic on/off operation of the circulating air blowers 80 and 82.

The blowers 80 and 82 draw ambient air from the space to be conditioned through cabinet intake opening 86 in the cabinet 12. As indicated by the arrows in FIG. 2, the air then passes through inlet openings 74, 76 into the housing 60 and heat transfer chamber 61. As the air enters the heat transfer chamber 61, it initially flows downwardly along the decoupler 28 between the rear wall 16 and the tailpipe 26. To that end, a wall 126 extending down from the bottom of the wall 64 cooperates with sidewalls 56 and 66 to direct the air along the proper flow path. Heat is transferred from the decoupler 28 and rear side of the tailpipe 26 to the air as it flows along the surfaces thereof.

The slightly warmer air passes below the decoupler 28 and/or tailpipe 26 as it is deflected by the condensate collection pan 118. Condensate is evaporated into the flowing air as it is deflected in an upward direction. In order to assure the proper flow direction, a seal surface 128 extends downwardly from the combustion chamber 24 to close the space between the top of the pan 92 and lower extent of the combustion chamber 24. Accordingly, the primary upward air flow is between the rear side of the combustion chamber 24 and the tailpipe 26 with significant additional heat transfer occurring.

The direction of flow of the heated air is reversed as it passes over the top of the combustion chamber 24 and downwardly along a path extending between the combustion chamber and the front wall 68 of the housing 60. The heat transfer process is completed during this last downward leg of the air flow path and initial portion **130*a* of a labyrinthine air flow passageway or discharge silencer 130. Accordingly, significant heat transfer and sound attenuation occur concurrently in the portion 130*a* of the discharge silencer 130**.

The downwardly flowing air in the passagway portion **130*a* impinges a baffle 132 for deflection away from the cabinet discharge opening 88 and toward a final portion 130*b* of the labyrinthine air flow passageway 130. The portion 130*b* includes sound attenuating material 134 and 136 comprising open cell foam pieces disposed at right angles to each other to form a wall oppositely spaced from the discharge opening 88. The foam pieces 134 and 136 extend along the width of the opening 88 to provide the final air flow passageway portion 130*b*** with opposed surface portions arranged in an open chamber configuration.

The foam pieces 134 and 136 are formed of acoustical open cell foam which is commercially available from the Sound Kote company. Decoupled foam may also be used as the sound attenuating material in accordance with the invention. Such foam comprises exterior foam layers and an intermediate layer of higher density plastic or other material which provides a floating acoustic barrier.

The steady state thermal efficiency, based on the flue loss measured at the outlet of the exhaust decoupler is about 90%. The percent of the total heat transferred by each burner element, based on flue gas temperatures at the exit of each element, is 71% for the combustion chamber, 15% for the tailpipe and 4% for the exhaust decoupler. The relatively high degree of heat transfer achieved in pulse combustion systems is related to the oscillatory component of the velocity of the combustion gases which results in an effective scrubbing of the heat transfer surfaces and prevents the formation of a fully developed boundary layer.

At a distance of about 3', the sound level of the heater 10 is about 53 dBA. This is achieved in part by the labyrinthine air flow passageway or discharge silencer. The deflection of the air flow away from the discharge opening into the final portion of the air flow passageway **130*b* is believed to be especially effective in muffling the overall transmission of sound from the interior housing 60 within the cabinet 12**.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A pulse combustion space heater for heating air in a space to be temperature conditioned including a cabinet having exterior walls providing a cabinet volume for enclosing and supporting the heater, said cabinet exterior walls including air intake and discharge openings, interior housing means located within said cabinet volume including walls providing a heat transfer chamber having inlet and outlet openings respectively communicating with said cabinet intake and discharge openings for circulating air from the space through the heat transfer chamber, pulse combustion burner means including a plurality of burner elements operably connected in a fluid-tight manner for pulse combustion of a combustible gaseous mixture and discharge of combustion products to the atmosphere remote of said space, said burner elements having exterior heat transfer surfaces located within said heat transfer chamber for transfer of combustion heat to air contacting said heat transfer surfaces, and blower means for circulating air from said space through said heat transfer chamber for heating by contact with said exterior heat transfer surfaces of said burner elements and back into said space, said heater including a discharge silencer through which the air passes prior to flow through said discharge opening in said cabinet, said discharge silencer comprising a labyrinthine air flow passageway lined with sound attenuation material arranged to cause changes in the direction of air flow to trap and dissipate acoustical energy.

2. A heater according to claim 1, wherein said labyrinthine air flow passageway includes a multi-functional portion in which heat transfer and sound attenuation occur simultaneously.

3. A heater according to claim 2, wherein said multi-functional portion is an initial portion of said air flow passageway located in said heat transfer chamber, said air flow passageway also includes a final portion adjacent said discharge opening, and said discharge silencer includes means to direct air flow away from said discharge opening in said cabinet and into said final portion of said air flow passageway.

4. A heater according to claim 3, wherein said means to direct air flow comprise a baffle arranged to deflect air flow away from said discharge opening in said cabinet, and said final portion of said air flow passageway comprises a wall of said sound attenuation material oppositely spaced from said discharge opening.

5. A heater according to claim 4, wherein said discharge opening has an elongated width dimension and said final portion of said air flow passageway comprises a narrow chamber extending along the width of said discharge opening, said narrow chamber having an elongate open side directly communicating with said discharge opening and an elongate closed side provided by said wall of sound attenuation material.

6. A heater according to claim 5, wherein said wall of sound attenuation material includes opposed surface portions for effecting said changes in direction of air flow.

7. A burner according to claim 2, wherein said burner elements include a combustion chamber which cooperates with an adjacent wall of the interior cabinet to provide said portion of said labyrinthine air flow passageway, said adjacent wall being a performated wall having a plurality of apertures therethrough and a layer of sound attenuating material on the side thereof remote of said combustion chamber.

8. A burner according to claim 7, wherein said perforated wall is sheet metal and said sound attenuating material is positioned against said sheet material.

9. A pulse combustion space heater for heating air in a space to be temperature conditioned including a cabinet having exterior walls providing a cabinet volume for enclosing and supporting the heater, said cabinet exterior walls including air intake and discharge openings, interior housing means located within said cabinet volume including walls providing a heat transfer chamber having inlet and outlet openings respectively communicating with said cabinet intake and discharge openings for circulating air from the space through the heat transfer chamber, pulse combustion burner means including a plurality of burner elements operably connected in a fluid-tight manner for pulse combustion of a combustible gaseous mixture and discharge of combustion products to the atmosphere remote of said space, said burner elements having exterior heat transfer surfaces located within said heat transfer chamber for transfer of combustion heat to air contacting said heat transfer surfaces, and blower means for circulating air from said space through said heat transfer chamber for heating by contact with said exterior heat transfer surfaces of said burner elements and back into said space, said heater including a discharge silencer through which the air passes prior to flow through said discharge opening in said cabinet, said discharge silencer comprising a labyrinthine air flow passageway lined with sound attenuation material arranged to cause changes in the direction of air flow to trap and dissipate acoustical energy, said burner elements including a combustion chamber which cooperates with an adjacent wall of the interior cabinet to provide a multi-functional portion of said labyrinthine air flow passageway within said heat transfer chamber in which heat transfer and sound attenuation occur simultaneously to thereby enhance the compactness of the space heater.

10. A heater according to claim 9, wherein said layer of sound attenuating material comprises a foil and glass fiber laminate, said adjacent wall is a perforated wall having a plurality of apertures therethrough and a layer of sound attenuating material on the side thereof remote of said combustion chamber.

11. A heater according to claim 10, wherein said burner elements are arranged to provide a serpentine flow path for air being circulated through said heat transfer chamber, and said serpentine flow path includes a final path portion which corresponds with said multi-functional portion of said air flow passageway.

12. A heater according to claim 9, wherein said burner elements also include a tailpipe, said tailpipe providing a flow conduit for combustion products from said combustion chamber, said tailpipe having a bilateral plane of symmetry and comprising an assembly of substantially identical tailpipe halves fabricated of sheet metal pieces sealed together along each side of said flow conduit.

13. A heater according to claim 12, wherein each tailpipe half comprises a single piece of sheet metal having a recess corresponding with one half of said flow conduit and flat surface portions on each side of said recess.

14. A heater according to claim 13, wherein each of said recesses has a generally rectangular cross-section and a U-shape to provide said flow conduit with a tubular U-shape configuration when said halves are assembled and sealed together.

15. A heater according to claim 14, wherein said tailpipe is a weldment and said tailpipe halves are sealed together by welding.

16. A pulse combustion heater for heating air in a space to be temperature conditioned including the burner in accordance with claim 12, said heater including means for circulating air from the space into contact with said tailpipe for transfer thereto of combustion heat.

17. A heater according to claim 9, wherein said burner elements also comprise a mixer head including air and fuel inlet means for admitting intersecting flows of air and fuel to be mixed in the mixer head to form said combustible gaseous mixture for pulse combustion in said burner means, said pulse combustion burner means also including means for supplying controllable flows of air and fuel to said mixer head air and fuel inlet means, means for igniting said air/fuel mixture in said mixer head for delivery to said combustion chamber, exhaust means connected to said combustion chamber, said combustion chamber and exhaust means cooperating to provide a resonant combustion of said air/fuel mixture and oscillating gas pressure in said burner means including alternating negative and positive operating pressure phases, said means for supplying controllable flows of air and fuel including a gas flapper valve for self-feeding fuel to said mixer head fuel inlet means in response to said alternating negative and positive operating pressure phases, and said mixer head fuel inlet means including a flow orifice for restricting and injecting said acceleration fuel admitted into said mixer head to maximize the turbulence of mixing and to reduces the mixing time.

18. A heater according to claim 17, wherein said means for supplying controllable flows of air and fuel include a fuel supply line connected to a supply of fuel under pressure, said gas flapper valve being connected in said fuel supply line between said supply of fuel and said mixer head fuel inlet means, and said flow orifice is arranged to use substantially the entire pressure difference between the pressure upstream of said gas flapper valve and the negative operation pressure phase of said burner.

19. A heater according to claim 18, wherein said flow orifice is the only flow metering orifice for regulating the average fuel flow rate through said gas line downstream of said gas flapper valve.

20. A heater according to claim 18, wherein said burner has an input rate of about 20,000 BTU/hr. and said flow orifice has an inside diameter equal to 0.136″±0.05″ I.D., said fuel is either natural gas or propane.

21. A heater according to claim 20, wherein said air inlet means has an air flow axis along which air is admitted into said mixer head and said air flow axis is spaced about 1⅝″ from said flow orifice.

22. A heater according to claim 18, wherein said mixer head has a flat box-like configuration including spaced front and back walls having associated edges joined by a peripheral wall, said mixer head having width and height dimensions which are each substantially greater than its depth dimension.

* * * * *